US010920296B2

(12) United States Patent
Chiu

(10) Patent No.: US 10,920,296 B2
(45) Date of Patent: Feb. 16, 2021

(54) ALLOY STEEL COMPOSITION AND PRODUCING METHOD THEREOF

(71) Applicant: ASUSTeK COMPUTER INC., Taipei (TW)

(72) Inventor: Shih-Wei Chiu, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 546 days.

(21) Appl. No.: 15/603,455

(22) Filed: May 24, 2017

(65) Prior Publication Data

US 2017/0342521 A1 Nov. 30, 2017

(30) Foreign Application Priority Data

May 24, 2016 (TW) ..... 10511604.1

(51) Int. Cl.

| | |
|---|---|
| ***C21D 9/00*** | (2006.01) |
| ***C22C 38/58*** | (2006.01) |
| ***C22C 38/04*** | (2006.01) |
| ***C21D 8/00*** | (2006.01) |
| ***C21D 1/20*** | (2006.01) |

(Continued)

(52) U.S. Cl.

CPC ..... *C21D 9/0068* (2013.01); *C21D 1/20* (2013.01); *C21D 1/607* (2013.01); *C21D 8/005* (2013.01); *C22C 38/04* (2013.01); *C22C 38/08* (2013.01); *C22C 38/18* (2013.01); *C22C 38/40* (2013.01); *C22C 38/58* (2013.01); *C23C 8/02* (2013.01); *C23C 8/26* (2013.01); *C21D 1/46* (2013.01); *C21D 2211/002* (2013.01); *C23C 18/1844* (2013.01); *C23C 18/32* (2013.01)

(58) Field of Classification Search

CPC ..... C21D 9/00; C21D 9/0068; C21D 1/20; C21D 1/607; C21D 1/46; C21D 8/005; C21D 2211/002; C22C 38/04; C22C 38/58; C23C 8/02; C23C 8/26; C23C 18/1844; C23C 18/32

See application file for complete search history.

(56) References Cited

U.S. PATENT DOCUMENTS 4,793,869 A * 12/1988 Krauss ..... C21D 9/52 148/566
2016/0304985 A1* 10/2016 Clarke ..... B23B 35/00

FOREIGN PATENT DOCUMENTS

CN 102676780 9/2012
CN 102676780 A * 9/2012 ..... C21D 1/25

(Continued)

OTHER PUBLICATIONS

CN 102676780 A Espacenet Machine Translation (Year: 2019).*

*Primary Examiner* — Alexandra M Moore
(74) *Attorney, Agent, or Firm* — JCIPRNET

(57) ABSTRACT

A method for producing an alloy steel composition includes the following steps: performing a first heat treatment on an alloy steel composition and maintaining for a first time period to soften the alloy steel composition; performing a first cooling treatment on the softened alloy steel composition; performing a treatment on the softened the alloy steel composition to form a workpiece; performing a second heat treatment on the workpiece and maintaining for a second time period; and performing a second cooling treatment on the workpiece to make the workpiece become to be a Bainite structure, and a cooling rate of the second cooling treatment is high than the cooling rate of the first cooling treatment.

4 Claims, 2 Drawing Sheets

(51) Int. Cl.

| | |
|---|---|
| ***C21D 1/607*** | (2006.01) |
| ***C23C 8/26*** | (2006.01) |
| ***C23C 8/02*** | (2006.01) |
| ***C22C 38/18*** | (2006.01) |
| ***C22C 38/40*** | (2006.01) |
| ***C22C 38/08*** | (2006.01) |
| *C21D 1/46* | (2006.01) |
| *C23C 18/32* | (2006.01) |
| *C23C 18/18* | (2006.01) |

(56) References Cited

FOREIGN PATENT DOCUMENTS

| | | | | |
|---|---|---|---|---|
| CN | 103981423 | | 8/2014 | |
| CN | 104152653 | | 11/2014 | |
| TW | 200538215 | | 12/2005 | |
| TW | 201341084 | | 10/2013 | |
| TW | 201341084 A | * | 10/2013 | ..... B22D 25/02 |

* cited by examiner

ALLOY STEEL COMPOSITION AND PRODUCING METHOD THEREOF

CROSS-REFERENCE TO RELATED APPLICATION

This application claims the priority benefit of TW application serial No. 105116041, filed on May 24, 2016. The entirety of the above-mentioned patent application is hereby incorporated by reference herein and made a part of specification.

BACKGROUND OF THE INVENTION

Field of the Invention

The invention relates to a material and a producing method thereof and, more particularly, to an alloy steel composition and a producing method thereof.

Description of the Related Art

As the technology develops, an electronic device tends to be light, small and thin. Consequently, electronic devices, such as a laptop computer, a mobile phone, a smart phone, a tablet computer, a music player, are developed. Generally, a cover of the portable electronic device is opened or closed relative to a body through the rotation of a hinge. However, due to the abrasion of the hinge, the maintenance action rate of the laptop computer is increased, and the lifetime of the laptop computer is reduced.

BRIEF SUMMARY OF THE INVENTION

According to a first aspect of the disclosure, a producing method of an alloy steel composition is provided. The producing method includes the following steps: performing a first heat treatment on an alloy steel composition and maintaining for a first time period to soften the alloy steel composition; performing a first cooling treatment on the softened alloy steel composition; performing a treatment on the softened the alloy steel composition to form a workpiece; performing a second heat treatment on the workpiece and maintaining for a second time period; and performing a second cooling treatment on the workpiece to make the workpiece become to be a Bainite structure, and a cooling rate of the second cooling treatment is high than the cooling rate of the first cooling treatment.

According to a second aspect of the disclosure, an alloy steel composition is provided. The alloy steel composition includes 95 wt % to 98 wt % iron and other metal materials are one or a combination of 0.1 wt % to 2.0 wt % chrome, 0.1 wt % to 2.0 wt % manganese, and 0.1 wt % to 2.0 wt % nickel.

In sum, the first heat treatment and the first cooling treatment are performed on the alloy steel composition to soften the alloy steel composition. The softened alloy steel composition is processed to form the workpiece. The second heat treatment and the second cooling treatment are performed on the workpiece, and then the workpiece becomes the Bainite structure, which increases the tenacity and the toughness of the workpiece. Consequently, the workpiece made by the alloy steel composition can be much thinner.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1:
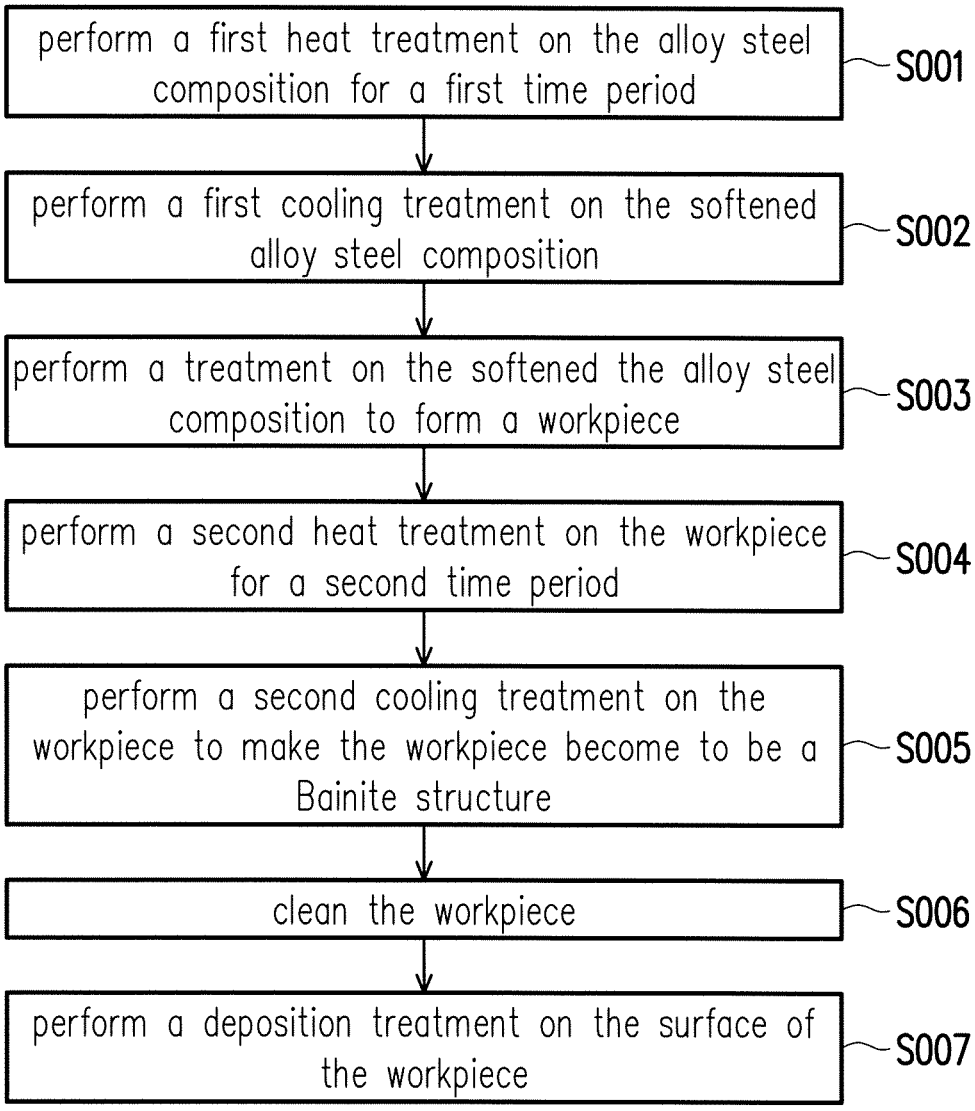
FIG. 1 is a flow diagram showing a producing method of an alloy steel composition material in an embodiment.
Figure 2:
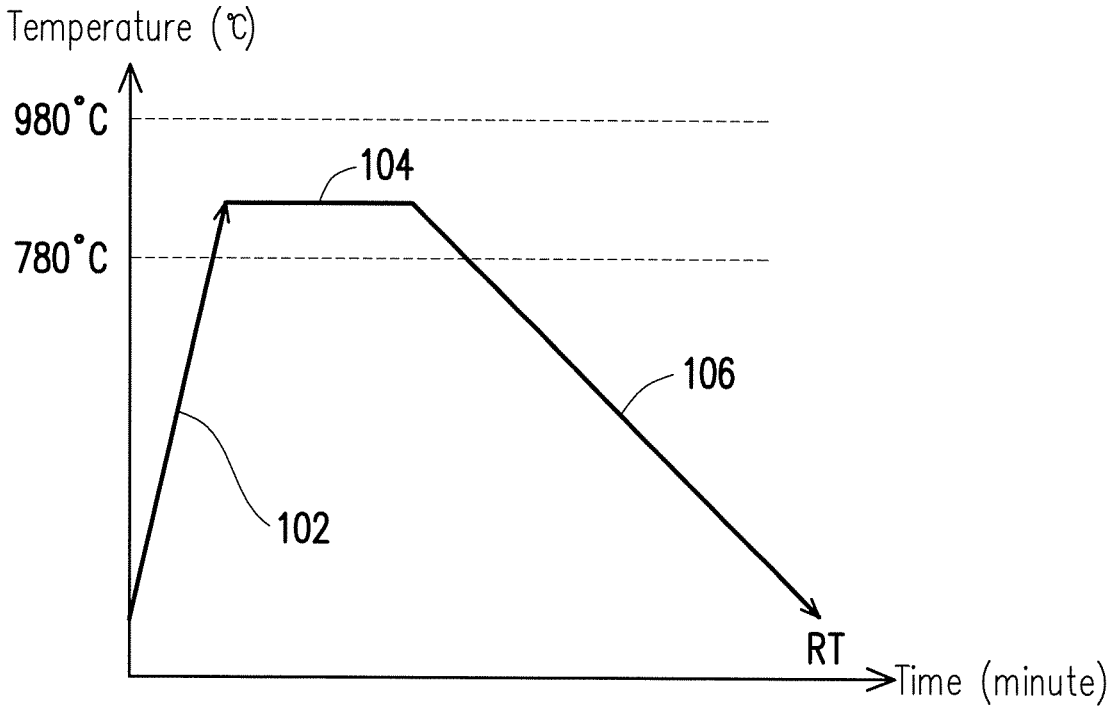
FIG. 2 is a schematic diagram showing a relationship between temperature and time of a first heat treatment in an embodiment.
Figure 3:
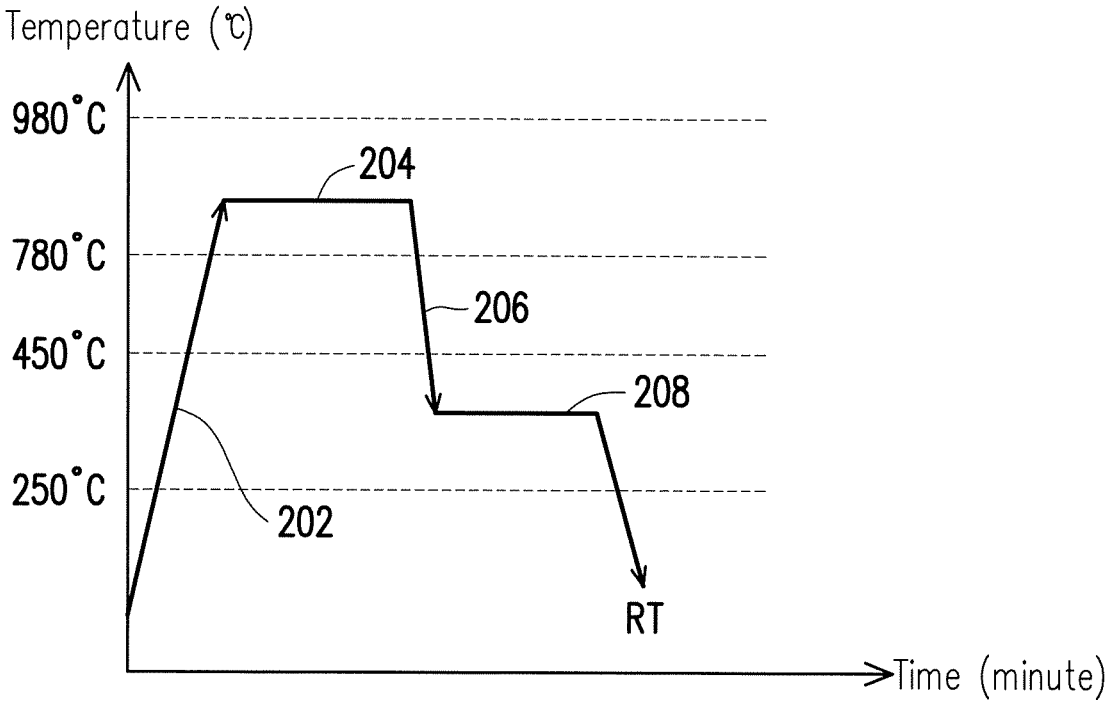
FIG. 3 is a schematic diagram showing a relationship between temperature and time of a second heat treatment in an embodiment.

FIG. 1 is a flow diagram showing a method of manufacturing an alloy steel composition in an embodiment. FIG. 2 is a schematic diagram showing a relationship between temperature and time of a first heat treatment in an embodiment. FIG. 3 is a schematic diagram showing a relationship between temperature and time of a second heat treatment in an embodiment.

Please refer to FIG. 1 and FIG. 2. An alloy steel composition is provided. In an embodiment, as the alloy steel composition measured by weight percentage, the alloy steel composition includes 95 wt % to 98 wt % iron. In an embodiment, the alloy steel composition further comprises one or a combination of 0.1 wt % to 2.0 wt % chrome, 0.1 wt % to 2.0 wt % manganese and 0.1 wt % to 2.0 wt % nickel, which is not limited herein. In the embodiment, the weight percentage of carbon in the alloy steel composition is less than 1 wt %. In an embodiment, the alloy steel composition is plate shaped, rod shaped, block shaped, which is not limited herein.

In step S001, the alloy steel composition is putted in a heat treatment furnace. Then a first heat treatment 102 is performed on the alloy steel composition for a first time period 104, so as to soften the alloy steel composition. In detail, as shown in FIG. 2, the first heat treatment 102 alloy steel composition is to gradually heat up to a temperature between 780° C. to 980° C. by a heating rate is 10° C. per minute to 100° C. per minute. Then, the temperature is maintained for the first time period 104. In an embodiment, the first time period 104 is between 5 minutes to 60 minutes. A range of the first time period 104 can be adjusted according to a size of the alloy steel composition. In embodiments, the heat treatment furnace is a continuous furnace, a batch furnace, a vacuum furnace or an atmosphere furnace of which the main body of the heat treatment furnace is heated above 900° C. for a time period, which is not limited herein.

In step S002, a first cooling treatment 106 is performed on the softened alloy steel composition. In detail, as shown in FIG. 2, in the first cooling treatment 106, the softened alloy steel composition is naturally cooled down to room temperature (RT), such as 20° C. to 30° C., at a cooling rate of 0.1° C. per minute to 10° C. per minute. In the embodiment, the cooling rate of the first cooling treatment 106 keeps the toughness of the softened alloy steel composition to avoid the hardening or the embrittlement. In detail, after the first heat treatment 102 and the first cooling treatment 106, the softened alloy steel composition is still solid, but with toughness that is less than the un-softened or un-treated alloy steel composition. In an embodiment, the toughness of the softened alloy steel composition is between HRB 80 to HRB 90, and the un-softened alloy steel composition is great than HRB 105 on the other hand.

In step S003, a treatment is performed on the softened alloy steel composition to form the workpiece via a processing platform such as one or a combination of a lathe, a milling machine, a punching machine, a drilling machine, and a planer, which is not limited herein. In the embodiment, the workpiece is one or combination of a hinge, a gasket of a portable electronic device which is not limited herein. In embodiments, the hinge is in a liner shape, a spring washer shape, a single package or double package, and a torque of the hinge is provided via the friction. In an embodiment, the portable electronic device is one or a combination of a laptop computer, a mobile phone, a smart phone, a tablet computer, and a music player, which is not limited therein.

In step S004, the workpiece is putted in the heat treatment furnace. Then the second heat treatment 202 is performed on the workpiece for a second time period 204. In detail, as shown in FIG. 3, a temperature of the second heat treatment 202 is gradually heated up to a temperature between 780° C. to 980° C. by a heating rate of 10° C. per minute to 100° C. per minute. The temperature is maintained for the second time period 204. In an embodiment, the second time period 204 is between 5 minutes to 60 minutes. In the embodiment, a phase transformation of the material of the workpiece is formed via the second heat treatment 202 and the second time period 204.

In step S005, a second cooling treatment 206 is performed on the workpiece. As shown in FIG. 3, the workpiece is putted in a salt bath at the temperature of 250° C. to 450° C. immediately for a third time period 208. In an embodiment, the third time period 208 is between 5 minutes to 60 minutes. And a Bainite structure with high tenacity and high toughness is produced. Consequently, the workpiece is more thinner and with a satisfied torque force.

Comparing to the conventionally water-quenching treatment or the oil-quenching treatment, the salt bath at the temperature between 250° C. to 450° C. makes the workpiece form the bainite structure, which keeps the tenacity and avoids the embrittlement. In addition, as shown in FIG. 2 and FIG. 3, the cooling rate of the second cooling treatment 206 is higher than that of the first cooling treatment 106. In other words, the second cooling treatment 206 at the cooling rate makes the workpiece becomes the Bainite structure completely. However, in an embodiment, if the workpiece is not putted in the salt bath immediately, the workpiece will become the Bainite structure partically. In an embodiment, the salt bath performs in a combination of nitrate, stannic chloride, calcium chloride, sodium carbonate, barium chloride by a device which includes heating function, soaking temperature function. In an embodiment, the salt bath can be performed in other salts with a melting point between 250° C. to 450° C.

After the workpiece is naturally cooled down to the room temperature RT, in step S006, a surface of the workpiece is cleaned by a cleaning method of soaking, flushing, spraying and/or shocking. The cleaning method and the cleaning detergent applied to the disclosure here can be any conventional one, which are not limited herein.

In step S007, a plating treatment is performed on the surface of the workpiece. In an embodiment, the plating treatment is one or a combination of a nickel plating treatment, an electroless plating treatment, a Ni-P coating treatment, a hard chrome plating treatment, a nitriding treatment. In an embodiment, any known plating treatment that for forming a layer with wear resistance and corrosion resistance on the outer surface or the inner surface of the workpiece can be applied to the disclosure.

After step S001 to S007, in the embodiment, the workpiece made by the alloy steel composition with high tenacity and high toughness is formed, and the alloy steel composition is the Bainite structure. In an embodiment, as measured by the weight percentage, the alloy steel composition comprises at least 95 wt % to 98 wt % iron. In an embodiment, one or a combination of 0.1 wt % to 2.0 wt % chrome, 0.1 wt % to 2.0 wt % manganese, 0.1 wt % to 2.0 wt % nickel are further comprised in the alloy steel composition, which is not limited herein. In an embodiment, the material of the alloy steel composition further includes carbon with less than 1 wt %.

In sum, the first heat treatment and the first cooling treatment are performed on the alloy steel composition to soften the alloy steel composition. The softened alloy steel composition is processed to form the workpiece. The second heat treatment and the second cooling treatment are performed on the workpiece, and then the workpiece becomes the Bainite structure, which increases the tenacity and the toughness of the workpiece. Consequently, the thickness of the workpiece made by the alloy steel composition is much thinner.

Although the invention has been disclosed with reference to certain preferred embodiments thereof, the disclosure is not for limiting the scope. Persons having ordinary skill in the art may make various modifications and changes without departing from the scope of the invention. Therefore, the scope of the appended claims should not be limited to the description of the preferred embodiments described above.

What is claimed is:

1. A producing method of an alloy steel composition, comprising:

performing a first heat treatment on the alloy steel composition for a first time period to soften the alloy steel composition, wherein a temperature of the first heat treatment, is gradually increased to a temperature between 780° C. to 980° C. at a heating rate of 10° C. per minute to 100° C. per minute, and the first time period is between 5 minutes to 60 minutes;

performing a first cooling treatment on the softened alloy steel composition, wherein a temperature of the first cooling treatment, is naturally cooled to a room temperature at a cooling rate of 0.1° C. per minute to 10° C. per minute;

performing a treatment on the softened alloy steel composition to form a workpiece;

performing a second heat treatment on the workpiece for a second time period, wherein the second heat treatment is gradually increased to a temperature between 780° C. to 980° C. at a heating rate of 10° C. per minute to 100° C. per minute, and the second time period is between 5 minutes to 60 minutes; and performing a second cooling treatment on the workpiece to make the workpiece become a bainite structure, wherein the second cooling treatment is that the workpiece is put in a salt bath of 250° C. to 450° C. for a third time period of 5 minutes to 60 minutes, wherein a cooling rate of the second cooling treatment is higher than the cooling rate of the first cooling treatment, and the alloy steel composition includes 95 wt % to 98 wt % iron and one or a combination of 0.1 wt % to 2.0 wt % chromium and 0.1 wt % to 2.0 wt % nickel.

2. The producing method according to claim 1, wherein the alloy steel composition includes carbon with less than 1 wt %.

3. The producing method according to claim 1, wherein after the second cooling treatment, the method further includes:

cooling the workpiece naturally to a room temperature;

cleaning the workpiece; and performing a plating treatment on a surface of the workpiece.

4. The producing method according to claim 1, wherein the softened alloy steel composition is solid, and the toughness of the softened alloy steel composition is less than the toughness of the alloy steel that is unsoftened.

* * * * *